US008535076B2

(12) United States Patent
Okamura

(10) Patent No.: US 8,535,076 B2
(45) Date of Patent: Sep. 17, 2013

(54) ELECTRICAL CONNECTOR

(75) Inventor: Seiji Okamura, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 320 days.

(21) Appl. No.: 13/016,110

(22) Filed: Jan. 28, 2011

(65) Prior Publication Data

US 2011/0189879 A1 Aug. 4, 2011

(30) Foreign Application Priority Data

Feb. 3, 2010 (JP) ..... 2010-022084

(51) Int. Cl.
*H01R 13/62* (2006.01)

(52) U.S. Cl.
USPC ..... 439/325

(58) Field of Classification Search
USPC ..... 439/492–495, 329, 629, 260, 625, 439/325
See application file for complete search history.

(56) References Cited

U.S. PATENT DOCUMENTS 6,210,209 B1 * 4/2001 Wu et al. ..... 439/495
6,254,435 B1 * 7/2001 Cheong et al. ..... 439/637
7,172,445 B2 * 2/2007 Shimoyama ..... 439/260
7,488,198 B2 * 2/2009 Shiu et al. ..... 439/495
2006/0040547 A1 * 2/2006 Asai ..... 439/495
2008/0009180 A1 * 1/2008 Ikuta et al. ..... 439/495

FOREIGN PATENT DOCUMENTS

JP 2000-195594 A 7/2000
JP 2006-190596 7/2006

* cited by examiner

*Primary Examiner* — Edwin A. Leon

(74) *Attorney, Agent, or Firm* — Kubotera & Associates LLC

(57) ABSTRACT

An electrical connector to be disposed on a circuit board includes a housing with two sidewalls, a plurality of first terminals, and a plurality of second terminals. The first terminals and the second terminals are attached to the one and the other of the sidewalls, respectively, and are situated near a bottom portion of the housing. The first terminal has a flexible first elastic arm portion. The first elastic arm portion extends upward. The first elastic arm portion has a first contact section that protrudes toward the flat conductive member. The second terminal has a flexible second elastic arm portion. The second elastic arm portion extends upward further than an upper end of the first elastic arm portion. The second elastic arm portion has a second contact section that protrudes towards the flat conductive member at a position above than the upper end of the first elastic arm portion.

10 Claims, 6 Drawing Sheets

ELECTRICAL CONNECTOR

BACKGROUND TECHNOLOGY AND RELATED TECHNOLOGY

The present invention relates to an electrical connector. More specifically, the present invention relates to an electrical connector such as a circuit board electrical connector to be mounted on a circuit board.

Patent Reference has disclosed a conventional circuit board electrical connector described. The conventional circuit board electrical connector is disposed on a circuit board for receiving a flexible flat cable (FFC) from above, so that the circuit board is connected to the FFC. The conventional electrical connector disclosed in Patent Reference includes a housing, a guide member attached to the housing to be slidable, an actuator rotatably attached to the housing, a plurality of terminals arranged and held in the housing, and a plurality of ground members arranged in the housing.

Patent Reference: Japanese Patent Publication No. 2006-190596

In the conventional circuit board electrical connector, the housing has a receiving hole for inserting the FFC from above, and the receiving hole passes through the housing in a vertical direction thereof. The terminals held are disposed in the housing and held on one of two sidewalls of the housing. The sidewalls are parallel to each other in a lateral direction of the housing, i.e., in a terminal arrangement direction.

More specifically, in the conventional circuit board electrical connector, terminal receiving grooves are provided in one of the sidewalls so as to extend through in the vertical direction. Holding sections of the terminals are pressed in the terminal receiving grooves from a bottom portion of the housing, so that the terminals are held in the housing. Each of the terminals has an elastic arm portion, which extends upward in the receiving hole from the bottom portion of the housing, and a contact section is formed at a tip of the elastic arm portion for elastically contacting with the FFC inserted from above.

In the conventional circuit board electrical connector, each of the ground members includes a straight section extending along an outer surface of the other of the sidewalls, a curved section folded back across an upper end part of the other of the sidewalls from an upper end of the straight section, and a ground contact section extending downward from the curved section along an inner surface of the other of the sidewalls.

In the conventional circuit board electrical connector, a ground attachment section is formed in the housing so as to protrude from an outer surface of the other of the sidewalls. The straight section of each of the ground members includes a securing section at a position close to the bottom portion of the housing, so that the ground attachment section holds the securing section. In addition, the upper end portion of the other of the sidewalls between the ground members extends upward, so that a ground receiving recesses is formed in a groove shape at a position of each of the ground members. Accordingly, the curved sections of the ground members are held in the ground receiving recesses.

In the conventional circuit board electrical connector, when the FFC is inserted in the receiving hole of the housing from above, the ground contact sections of the ground members are pressed against the FFC, so that an upper side portion of the straight section from the securing section to the ground contact section becomes elastically deformed to be slightly away from the other of the sidewalls of the housing.

As described above, in the conventional circuit board electrical connector disclosed in Patent Reference, each of the ground members includes the curved section that is folded back across the upper end of the other of the sidewalls of the housing. Accordingly, a height of the ground member is larger than that in a case when the ground member is made to have a dimension substantially the same as the housing.

In addition, as described above, the upper end portion of the other of the sidewalls between the ground members extends upward, so that the ground receiving recesses is formed in the groove shape for holding the curved section of each of the ground members. Accordingly, the height of the housing becomes larger by a dimension above the upper end section to form the extending section. Furthermore, the ground attachment section to hold the straight section of the ground member is formed protruding from the outer surface of the other wall. Accordingly, the dimension of the housing becomes larger in a thickness direction of the sidewall. As a result, an entire size of the conventional circuit board electrical connector increases in the height direction and the thickness direction.

In view of the above, an object of the present invention is to provide a circuit board electrical connector capable of increasing a spring length of a terminal without increasing an entire size of the circuit board electrical connector.

Further objects and advantages of the present invention will be apparent from the following description of the present invention.

SUMMARY OF THE INVENTION

In order to attain the objects described above, according to the present invention, an electrical connector to be disposed on a circuit board includes a housing, which has two sidewalls perpendicular to a surface of the circuit board and receives a flat conductive member in a receiving space formed between the two sidewalls from above. The electrical connector further includes a plurality of first terminals to be held by one of the sidewalls in an arrangement direction thereof parallel to the surface of the circuit board, and a plurality of second terminals to be held by the other of the sidewalls in an arrangement direction thereof.

According to the present invention, in the circuit board electrical connector, the first terminals and the second terminals are attached to the one and the other of the sidewalls, respectively, and are situated near a bottom portion of the housing. Each of the first terminals has a flexible first elastic arm portion. The first elastic arm portion extends upward from the bottom portion at a position closer to the other of the sidewalls than the flat conductive member between the sidewalls. The first elastic arm portion has a first contact section that protrudes toward the flat conductive member, and can elastically contact with the flat conductive member at the first contact section.

According to the present invention, in the circuit board electrical connector, each of the second terminals has a flexible second elastic arm portion. The second elastic arm portion extends upward further than an upper end of the first elastic arm portion. The second elastic arm portion has a second contact section that protrudes towards the flat conductive member at a position above than the upper end of the first elastic arm portion, and can elastically contact with the flat conductive member at the second contact section.

According to the present invention, the second terminal is attached to the other of the sidewalls near the bottom portion of the housing, and the second elastic arm portion of the second terminal extends upward between the sidewalls. Therefore, different from the conventional circuit board electrical connector, the housing does not have the curved section that is provided across an upper end section of the other of the sidewalls, so that a height of the terminal is smaller by a corresponding length. In the housing, it is not necessary to form a recess to hold the curved section of the ground member, so that the height of the housing does not become large. Moreover, it is not necessary to form the section protruding from an outer surface of the other of the sidewalls to secure the second terminal, so that a dimension of the housing in a thickness direction thereof does not increase.

According to the present invention, in the circuit board electrical connector, the second elastic arm portion is formed to extend to near the upper end part of the sidewall within a height range of the other of the sidewalls of the housing. Accordingly, it is possible to secure an enough spring length within a height dimension of a height range of the housing.

According to the present invention, in the circuit board electrical connector, the second elastic arm portion extends in an inclined state so as to be away from the other of the sidewalls as the second elastic arm portion extends upward. Further, the second elastic arm portion is situated to approaching the other of the sidewalls as the second elastic arm portion extends upward from the bent portion at a middle point of the second elastic arm portion. It is preferred that the second contact section is formed at the bent section of the second elastic arm portion.

According to the present invention, in the circuit board electrical connector, when the flat conductive member with a regular thickness is inserted between the sidewalls and contacts with the second contact sections of the second terminals, the second contact sections receive a pressing force from the flat conductive member. Therefore, the second elastic arm portions elastically displace as a whole toward the other of the sidewalls. It is noted that the second elastic arm portion of the second terminal is held like a cantilever in a free state. Accordingly, the second elastic arm portions can easily displace.

In addition, when the flat conductive member has a large thickness, the second contact sections elastically deform to a large extent. When the second contact sections elastically deform for a displacement amount greater than a specific displacement amount, the upper end section of the second elastic arm portion contacts with the other of the sidewalls, so that the second elastic arm portion becomes a bar fixed at the both ends, thereby preventing a further elastic deformation. As a result, it is possible to prevent an excess elastic deformation and the second elastic arm portion from being damaged (permanent deformation in fatigue). Further, it is possible to achieve a large contact pressure.

According to the present invention, in the circuit board electrical connector, the first terminals and the second terminals are preferably held at the same positions in the arrangement direction.

In general, the flat conductive member may include a first circuit section that corresponds to the first terminals and a second circuit section that corresponds to the second terminals. The first circuit section and the second circuit section are formed in two layers in a thickness direction of the flat conductive member. The first circuit section and the second circuit section include connection pad portions disposed at the same vertical positions on a surface of the flat conductive member in the width direction thereof.

According to the present invention, the first terminals and the second terminals may be situated at the same positions in the arrangement direction. Accordingly, when the first circuit section and the second circuit section include the connection pads disposed at the same positions in the width direction, it is possible to electrically connect the first terminals and the second terminals to the first circuit section and the second circuit section arranged with a small pitch in the width direction.

According to the present invention, the circuit board electrical connector may further include a pressing member that can pivotally move between an open position where the flat conductive member can be inserted into the receiving space of the housing and a close position where the flat conductive member is pressed against the first contact sections of the first terminals and the second contact sections of the second terminals.

According to the present invention, in the circuit board electrical connector, the pressing member may have a rotary shaft section as a rotary center thereof disposed at the same position as at least a part of the first terminal. Further, the part of the first terminals has a support arm portion that extends upward at a position closer to the one of the sidewalls than the flat conductive member. The support arm portion may have a rotary support section that rotatably supports the rotary shaft section. In addition, the second terminal may function as a ground terminal.

As described above, according to the present invention, in the circuit board electrical connector, the first terminals and the second terminals are attached near the bottom portion of the housing. Further, the first elastic arm portion of each of the first terminals and the second elastic arm portion of each of the second terminals extend upward between the sidewalls of the housing.

On the other hand, in the conventional circuit board electrical connector, the terminal is disposed such that the straight section thereof is situated along the outer surface of the sidewall. Further, the curved section is formed by folding the terminal over the upper end part of the sidewall. In contrast, the circuit board electrical connector of the present invention does not have the curved section. Accordingly, as opposed to the conventional circuit board electrical connector, it is possible to reduce a dimension of the circuit board electrical connector in a height direction of the housing.

In addition, in the circuit board electrical connector of the present invention, it is not necessary to form the holding section to hold the terminal at the outer surface of the sidewall as in the conventional circuit board electrical connector. Accordingly, it is possible to reduce the dimension of the circuit board electrical connector in the thickness direction of the sidewall. As a result, it is possible to reduce the size of the circuit board electrical connector both in the height direction and the thickness direction.

Furthermore, in the circuit board electrical connector of the present invention, it is possible to extend the second elastic arm portion of the second terminal from the bottom portion of the housing to near the upper end section of the sidewall within the range of the height of the other of the sidewalls. Accordingly, it is possible to increase a length of the second elastic arm portion. As a result, it is possible to obtain the sufficiently long spring length, so that the second elastic arm portion can easily elastically displace, thereby making it easy to insert the flat conductive member.

BRIEF DESCRIPTION OF THE DRAWINGS

FIGS. 3(A) and 3(B) are longitudinal sectional views showing the circuit board electrical connector before the flat conductive member is inserted into the circuit board electrical connector according to the embodiment of the present invention, wherein FIG. 3(A) is a sectional view of the circuit board electrical connector taken along a line IIIA-IIIA in FIG. 1 and FIG. 3(B) is a sectional view of the circuit board electrical connector taken along a line IIIB-IIIB in FIG. 1;

FIGS. 5(A) and 5(B) are views showing the circuit board electrical connector according to the embodiment of the present invention, wherein FIG. 5(A) is a bottom view of the circuit board electrical connector and 5(B) is a sectional view of the circuit board electrical taken along a line VB-VB in FIG. 3(B); and FIGS. 6(A) and 6(B) are longitudinal sectional views showing the circuit board electrical connector after the flat conductive member is inserted into the circuit board electrical connector according to the embodiment of the present invention, wherein FIG. 6(A) is a sectional view of the circuit board electrical connector corresponding to FIG. 3(A) and FIG. 6(B) is a sectional view of the circuit board electrical connector corresponding to FIG. 3(B).

DETAILED DESCRIPTION OF THE PREFERRED EMBODIMENTS

Hereunder, embodiments of the present invention will be described with reference to the accompanying drawings.

Figure 1:
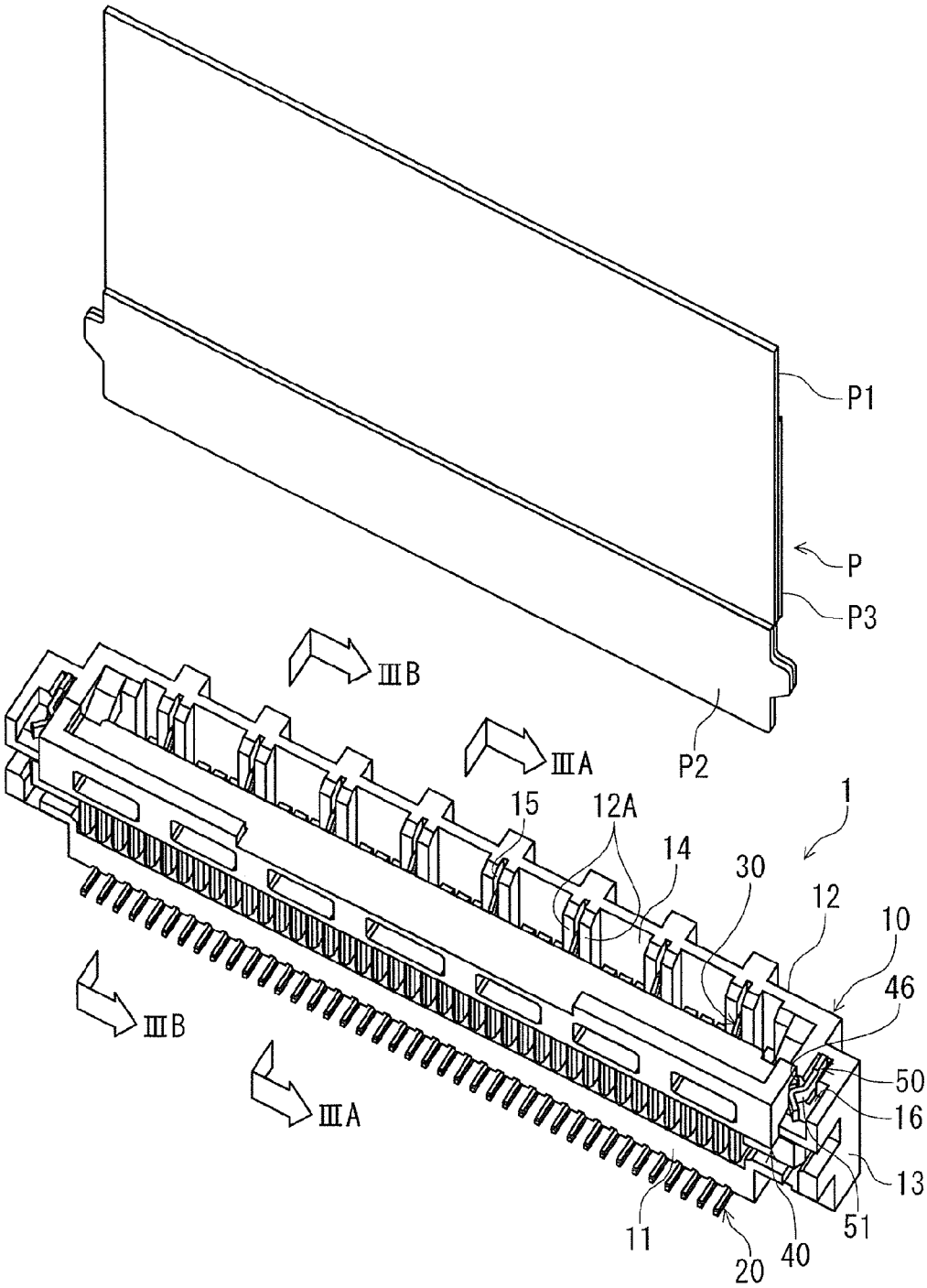
FIG. 1 is a perspective view showing a circuit board electrical connector and a flat conductive member before the flat conductive member is inserted into the circuit board electrical connector in a state that a pressing member is situated at an open position according to an embodiment of the present invention.
Figure 2:
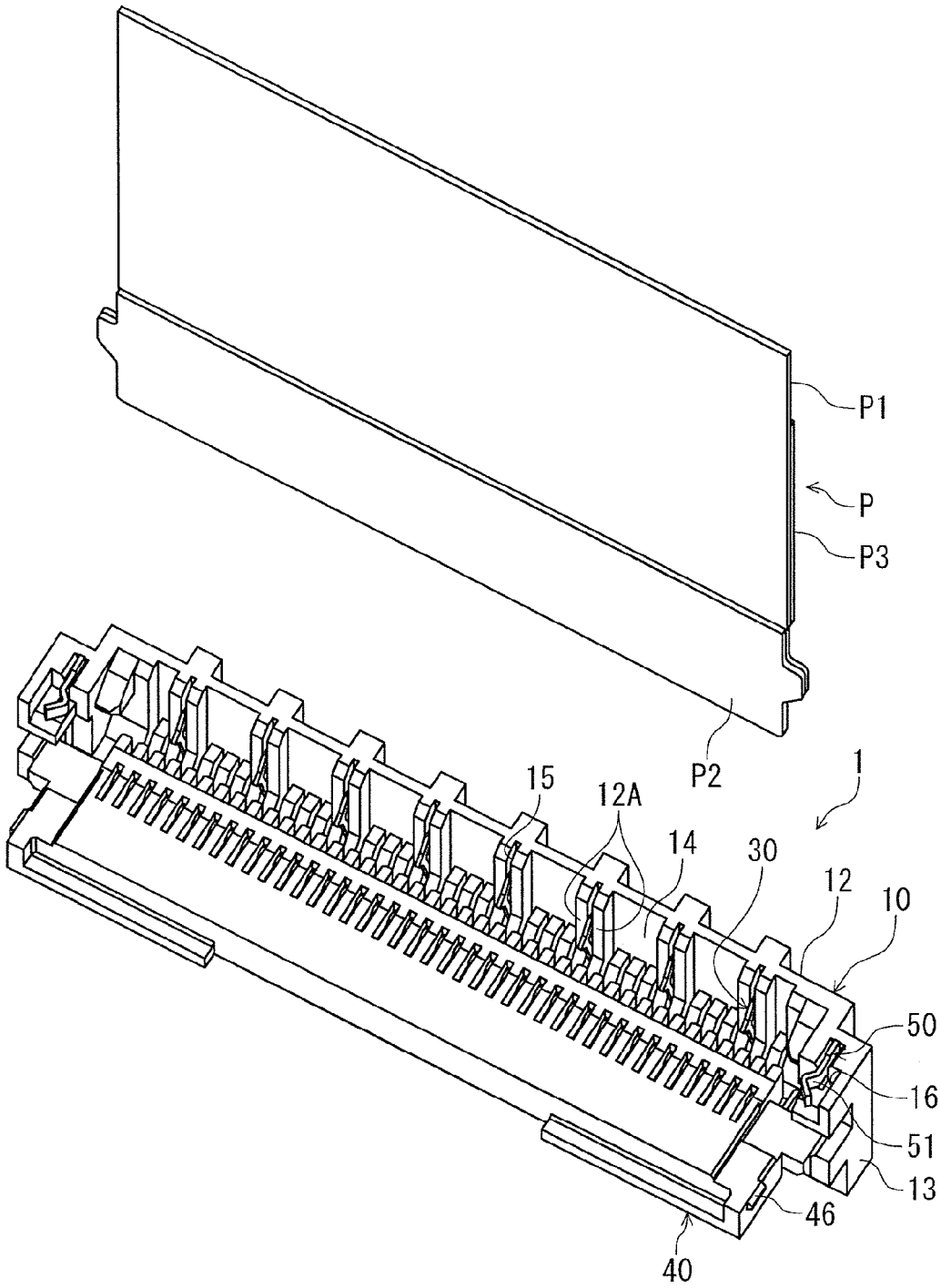
FIG. 2 is a perspective view showing the circuit board electrical connector and the flat conductive member before the flat conductive member is inserted into the circuit board electrical connector in a state the pressing member is situated at a close position according to the embodiment of the present invention.

FIG. 1 is a perspective view of a circuit board electrical connector 1 and a flat conductive member before insertion of the flat conductive member P according to an embodiment of the present invention, in which a pressing member 40 is in an open state. FIG. 2 is a perspective view of the circuit board electrical connector 1 shown in FIG. 1 and the flat conductive member P before an insertion of the flat conductive member P, in which the pressing member 40 is in a close position.

In the embodiment of the present invention, the circuit board electrical connector 1 (hereinafter simply referred to as the connector 1) is an electrical connector to be disposed on a circuit board (not illustrated), and receives the flat conductive member P from above and then connects to the flat conductive member P.

As shown in FIG. 1, one surface of a main body P1 of the flat conductive member P has a reinforcing plate P2 attached onto a lower end portion. On the other surface of the main body P1, connection pads (not illustrated) of a signal circuit section to be connected to first terminals 20, which will be described later, are exposed at the lower end portion, and the connection pads are formed being arranged in the width direction of the flat conductive member P. A ground bar P3 as a ground circuit section to be connected to second terminals 30, which will be described later, is attached across the whole width direction at a position near the lower end part of the main body P1 but above the signal circuit section.

In other words, in the flat conductive member P, the signal circuit section that corresponds to the first terminals 20 and the ground bar P3 that corresponds to the second terminals 30 are formed in two layers along the thickness direction of the flat conductive member P. In addition, the connection pad portion of the signal circuit section is disposed below the ground bar P3 while extending over the same width position of the flat conductive member P on the other surface of the flat conductive member P.

In the embodiment of the present invention, the connector 1 includes a housing 10, which has an outer shape of a generally rectangular solid and receives the flat conductive member P from above, first terminals 20, which are arranged and held as signal terminals at the equal intervals in the longitudinal direction of the housing 10 (the terminal arrangement direction that is horizontal to a circuit board surface), second terminals 30 as ground terminals, a pressing member 40 that can freely pivotally move between the open position shown in FIG. 1 and the close position shown in FIG. 2, and a locking hardware 50 to hold the pressing member 40 attached onto the housing 10 at the open position.

The housing 10 includes a sidewall 11 and a sidewall 12, which extend vertically from a surface of the circuit board and are parallel to each other in the longitudinal direction, and two end walls 13 that respectively join the ends of the sidewall 11 and the sidewall 12. The space, which is formed by the sidewalls 11 and 12 and the end walls 13 and is opened upward, is formed as a receiving groove 14, which is receiving space to receive the flat conductive member P from above.

As will be described later, the first terminals 20 are arranged along and held by the sidewall 11, and the second terminals 30 are arranged along and held by the sidewall 12. As shown in FIG. 1, there are provided less number of the second terminals 30 than the first terminal 20, and the second terminals 30 are provided in positions corresponding to a part of the plurality of the first terminals 20 in the terminal arrangement direction. Accordingly, in the embodiment, since the second terminals 30 are held at the same positions as the first terminals 20 in the terminal arrangement direction, it is possible to electrically connect to the circuit sections that are arranged at tight pitches in the width direction in the flat conductive member P.

As well shown in FIGS. 1 and 2, the sidewall 12 has pairs of protruding strips 12A, which vertical extend, at positions where the second terminals 30 are respectively held along the lateral direction, i.e. terminal arrangement direction, so as to protrude from an inner wall surface of the sidewall 12 toward inside of the receiving groove 14. As will be described later, the groove between each pair of the protruding strips 12A composes a part of the receiving groove 15 to hold a part of the first terminals 20 and the second terminals 30.

As can be seen in FIGS. 1 and 2, each end wall 13 has a recess 16 to house and hold the locking hardware 50, being opened upward, and has a locking hardware attachment hole (not illustrated), which is formed therethrough in the vertical direction, on a bottom portion of the recess 16. The recess 16 is made wider in the terminal arrangement direction near the sidewall 11 where the sidewalls 11 face each other, and allows elastic displacement of the locking hardware 50 at the wider portion.

Figure 3B:
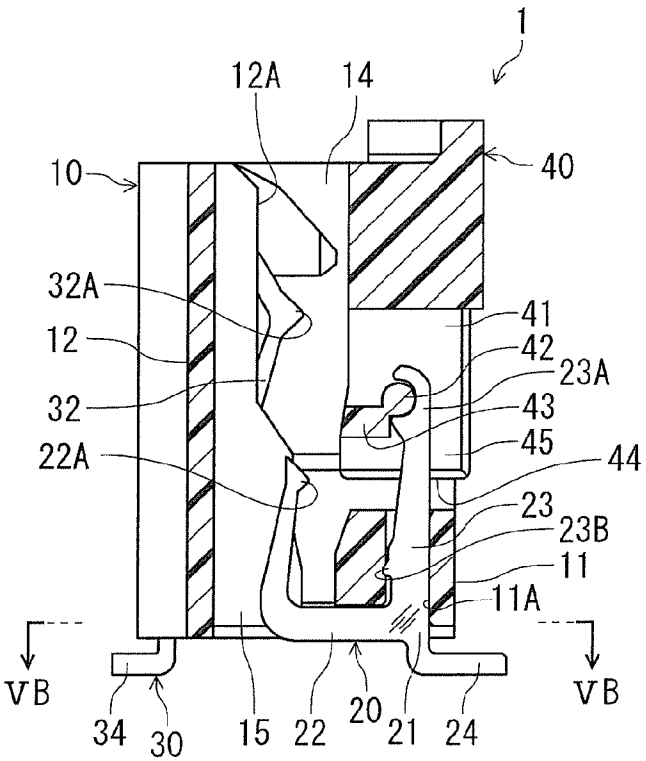
Figure 3A:
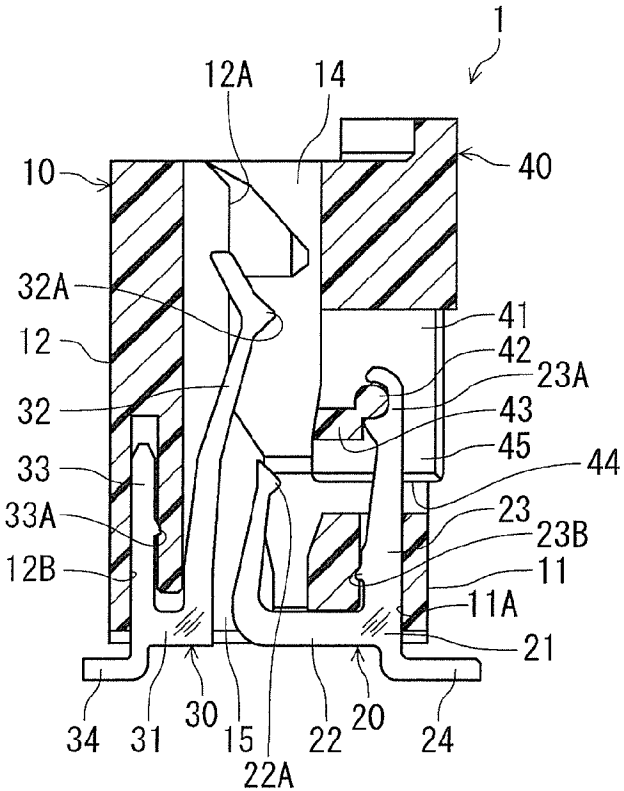

FIGS. 3(A) and 3(B) are longitudinal sectional views showing the circuit board electrical connector 1 before the flat conductive member P is inserted into the circuit board electrical connector 1 according to the embodiment of the present invention. FIG. 3(A) is a sectional view of the circuit board electrical connector 1 taken along a line IIIA-IIIA in FIG. 1. FIG. 3(B) is a sectional view of the circuit board electrical connector 1 taken along a line IIIB-IIIB in FIG. 1.

More specifically, FIG. 3(A) shows a section which includes both first terminal 20 and second terminal 30 that are respectively arranged in the terminal arrangement directions. FIG. 3(B) shows a section, which includes only the first terminal 20 that is arranged in the terminal arrangement direction.

As shown in FIGS. 3(A) and 3(B), as for the sidewall 11 and the sidewall 12 that face each other, one sidewall 11 has a smaller height than the other sidewall 12. The sidewall 11 includes attachment holes 11A, which are provided therethrough in the vertical direction to attach the first terminals 20. In addition, as shown in FIG. 3(A), the sidewall 12 has attachment holes 12B, which are opened downward to attach the second terminals 30.

Figure 4:
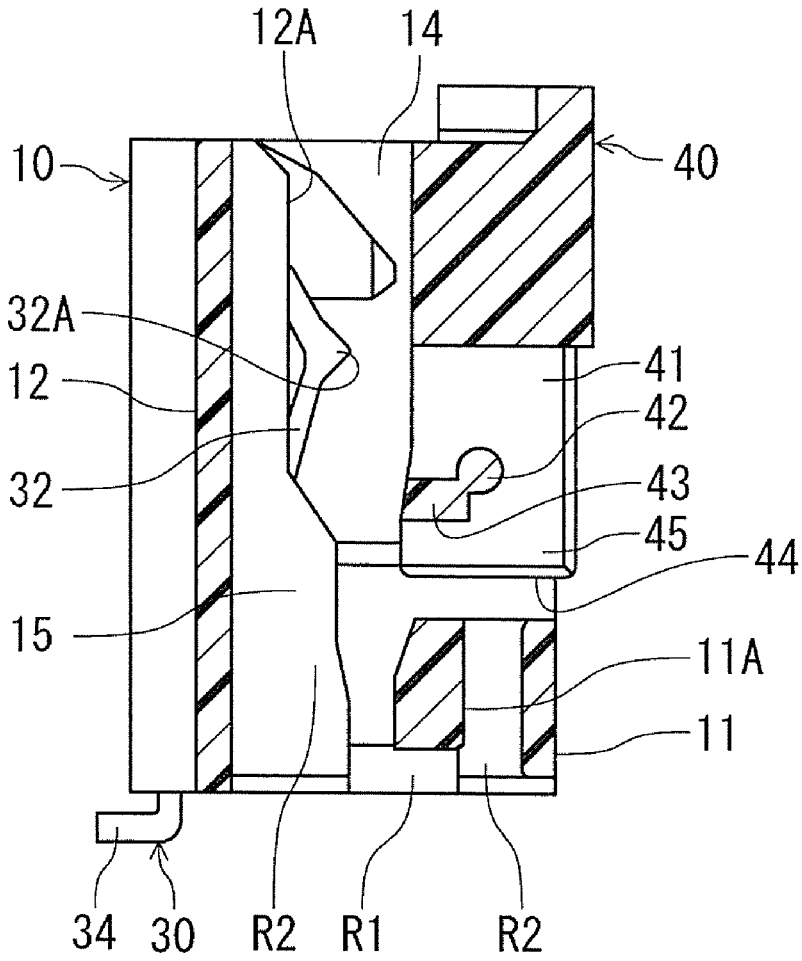
FIG. 4 is a sectional view of the circuit board electrical connector corresponding to FIG. 3(B) in a state that first terminals and second terminals is omitted according to the embodiment of the present invention.

In the embodiment of the present invention, the housing 10 vertically extends along the inner wall surface of the sidewall 12 and has a housing groove 15, which is provided so as to face the sidewalls 11 and 12, as housing space to house the first terminals 20 and the second terminals 30 (see also FIG. 4). More specifically, the housing groove 15 extends in the vertical direction from an upper end of the housing 10 to a the lower end, and extends in the facing directions from the inner wall surface of the sidewall 12 to under the attachment hole 11A of the sidewall 11, so as to have a generally L-shape as a whole (see also FIG. 4).

The housing groove 15 communicates with the receiving groove 14 and has a lower opening, and houses the first terminals 20 and the second terminals 30 from the lower opening. The lower opening communicates to the attachment holes 11A and 12B. The groove width of the housing groove 15, i.e. the dimension in a direction orthogonal to the paper surface, will be described later.

Each of the first terminals 20 is made by punching sheet metal while keeping its plate surface. As shown in FIGS. 3(A) and 3(B), each first terminal 20 includes a flexible first elastic arm portion 22, which extends leftward and then upward and has a generally L-shape, a straight support arm portion 23, which extends upward from a basal section 21 of the first elastic arm portion 22, and a first connecting section 24, which extends downward from the basal section 21, then rightward and extends outside the housing 10 forming a crank-shape. It is noted that the first connecting section 24 of the first terminal 20 extends outside the sidewall 11 (the right side in FIGS. 3(A) and 3(B)).

In the embodiment of the present invention, the first elastic arm portion 22 comprises a generally horizontal part, which extends leftward from the basal section 21, and a generally vertical part, which extends upward from the left end of the generally horizontal part, which is closer to the sidewall 12 than the receiving groove 14. The first elastic arm portion 22 has, at its upper end of the vertical part, a first contact section 22A for elastically contacting with the signal circuit section of the flat conductive member P, so as to protrude inside the receiving groove 14 toward the inserted flat conductive member P (see also FIGS. 6(A) and 6(B)).

The support arm portion 23 includes at its upper end part a rotary support section 23A, which is opened leftward to be a round concave shape. As will be described, the rotary support section 23A freely rotatably supports the rotary shaft 42 of the pressing member 40. The support arm portion 23 has a pressing protrusion 23B formed to protrude from the left edge at a relatively lower position thereof. The first connecting section 24 is provided lower than the bottom portion of the housing 10, and a lower edge of a portion that extends rightward is designed to be connected by soldering to the signal circuit section (not illustrated) on the circuit board.

Once the support arm portion 23 is pressed into the attachment hole 11A of the sidewall 11 of the housing 10 from thereunder, the pressing protrusion 23B of the support arm portion 23 latches onto the inner wall surface of the attachment hole 11A and thereby the first terminal 20 is held by the sidewall 11 near the bottom portion of the housing 10.

In addition, with the first terminal 20 being held by the sidewall 11, the support arm portion 23 penetrates through the attachment hole 11A and the upper half portion extends upward from the attachment hole 11A. Moreover, as shown in FIGS. 3(A) and 3(B), the first elastic arm portion 22 has its most part housed in the housing groove 15, and the first contact section 22A sticks out from the housing groove 15 to the receiving groove 14.

Similarly to the first terminals 20, each second terminal 30 is made by punching sheet metal keeping the plate surface. As shown in FIG. 3(A), each second terminal 30 includes a second elastic arm portion 32, which extends upward, a straight attachment arm 33, which extends upward from a left part of the basal section 31 of the second elastic arm portion 32, and a second connecting section 34, which extends downward from the left part of the basal section 31 and then extends leftward so as to have a crank-like shape to extend outside the housing 10. It is noted that the second connecting section 34 of the second terminal 30 extends outside the sidewall 12 (the left side in FIGS. 3(A) and 3(B)).

As well shown in FIG. 3(A), the second elastic arm portion 32 extends tilting to the middle position so as to be gradually away from the sidewall 12 as it goes upward, and then extends being tilted from the bent part near the upper end of the second elastic arm portion 32 so as to approach the sidewall 12 as it goes upward. At the bent part of the second elastic arm portion 32, there is provided a second contact section 32A for elastically contacting with the ground bar P3 of the flat conductive member P, which protrudes into the receiving groove 14 so as to contact with the inserted flat conductive member P (see also FIGS. 6(A) and 6(B)).

In the embodiment of the present invention, the attachment arm 33 has a pressing protrusion 33A, which vertically protrudes at a generally center position on the right edge. The second connecting section 34 is provided lower than the bottom portion of the housing 10 and is designed to have the lower end part of the part extending leftward be connected by soldering to a ground circuit section (not illustrated) on the circuit board.

The attachment arm 33 is pressed into the attachment hole 12B of the sidewall 12 of the housing 10 from below, and the pressing protrusion 33A of the attachment arm 33 latches onto the inner wall surface of the attachment hole 12B, and thereby the second terminal 30 becomes held by the sidewall 12 near the bottom portion of the housing 10. The second elastic arm portion 32 has its most part housed in the housing groove 15, and the second contact section 32A protrudes from the housing groove 15 into the receiving groove 14.

As shown in FIG. 3(A), being closer to the sidewall 12 than the first elastic arm portion 22 of the first terminal 20, the second elastic arm portion 32 extends higher than the upper end of the first elastic arm portion 22 from the bottom portion of the housing 10. Moreover, the second contact section 32A of the second elastic arm portion 32 is provided higher than the first contact section 22A of the first elastic arm portion 22.

In the embodiment of the present invention, the second terminal 30 is attached to the sidewall 12 from below, and the second elastic arm portion 32 of the second terminal 30 extends upward in the housing groove 15. In other words, being different from ground members that extend along an outer surface of the sidewall of the housing and are curved being folded back across the upper end as in a conventional one, since the second terminal 30 does not have the curved section that is provided over the upper end of the sidewall 12, it is possible to reduce the height dimension of the second terminal 30.

Even in the housing 10, since it is not necessary to form a recess to house the curved section of the ground member as in a conventional one, it is possible to reduce the height dimension of the housing 10. Furthermore, it is also not necessary to form a portion to secure the second terminal 30 by forming a protrusion from the outer surface of the sidewall 12 as in a conventional one, so that it is also possible to reduce the dimension of the housing 10 in the thickness direction of the sidewall 12. As a result, it is also possible to reduce the size of the connector 1 in the height direction and the thickness direction.

According to the embodiment, since the second elastic arm portion 32 can be made longer within height range of the sidewall 12 by extending to near the upper end of the sidewall 12, the second elastic arm portion 32 can securely have enough spring length even if the height dimension of the second elastic arm portion 32 is in the height range of the housing 10. Accordingly, since the second elastic arm portion 32 can easily elastically deform by increasing the spring length of the second elastic arm portion 32, it is easier to insert the flat conductive member P into the receiving groove 14.

In addition, according to the embodiment, since the first terminals 20 and the second terminals 30 may be attached respectively by pressing from the same direction to the sidewall 12 and the sidewall 13 of the housing 10, it is possible to easily attach the first terminals 20 and the second terminals 30 to the housing 10 and easily produce even the connector 1.

More specifically, the connector 1 is configured such that both the first terminals 20 and the second terminals 30 are attached to the housing 10 from the bottom portion thereof (in the same direction). Further, the connector 1 is configured such that both the first terminals 20 and the second terminals 30 are arranged at the same positions in the arrangement direction thereof.

Furthermore, as shown in FIG. 3(A), since the first terminals 20 as signal terminals and the second terminals 30 as ground terminals can be provided being close to each other within the housing space 15 without interposing any member therebetween, such as the housing 10, it is easy to adjust transmission characteristics of electrical signals.

Figure 5A:
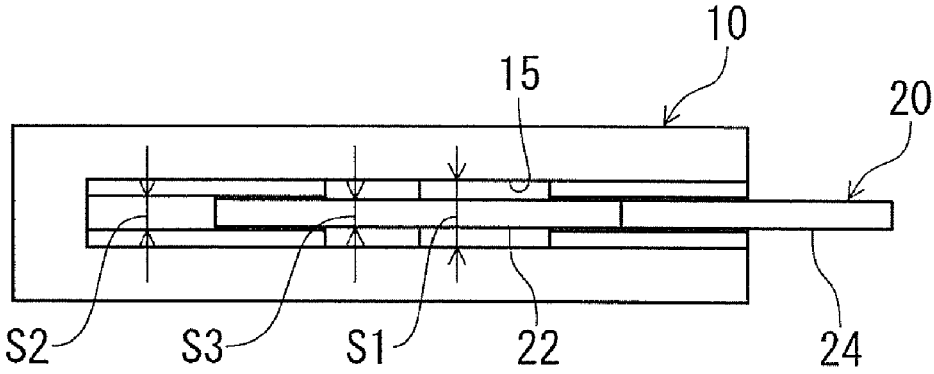
Figure 5B:
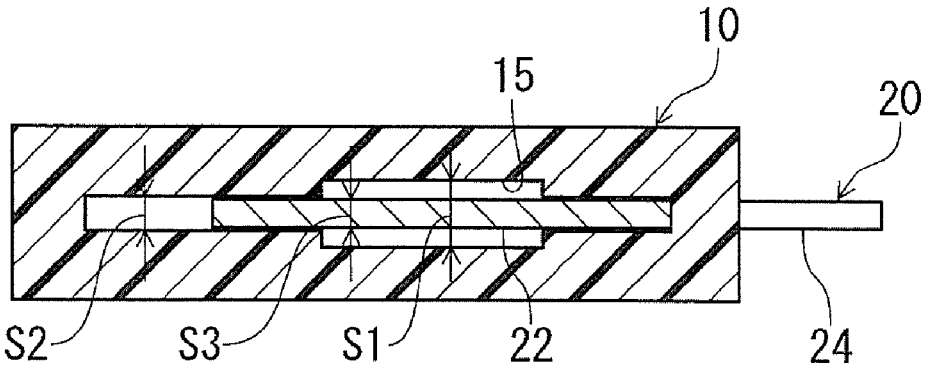

FIG. 4 is a sectional view of the connector 1 shown in FIG. 3(B), in which illustration of the first terminals 20 and the second terminals 30 is omitted. FIG. 5(A) is a bottom view of the connector 1 shown in FIG. 3(B), and FIG. 5(B) is a VB-VB sectional view of the connector 1 shown in FIG. 3(B). Here, FIGS. 5(A) and (B) are a bottom view and a sectional view taken near the first terminals 20 in the terminal arrangement direction, in which illustration of other parts is omitted.

The groove width of each generally L-shaped receiving groove 15 in the housing 10 is slightly larger than the thicknesses of the first terminals 20 and the second terminals 30 in the most part (a region R2 in FIG. 4), and there is a slight gap formed between plate surfaces of the first terminals 20 and the second terminals 30. These gaps allow the elastic displacement of the first terminals 20 and the second terminals 30 in a direction that is parallel to the plate surface, and the groove's inner wall surfaces that form each gap are designed to restrict excess displacement of the first terminals 20 and the second terminals 30 more than allowed in a direction that is orthogonal to the plate surface, i.e. the terminal arrangement direction.

Furthermore, in a partial region that houses the horizontal part of the first elastic arm portion 22 of each first terminal 20 (a region R1 in FIG. 4), there is formed a wider gap than the above-described gap of the other area (the region R2 in FIG. 4) from plate surfaces of the second terminals 30. More specifically, as shown in FIGS. 5(A) and 5(B), the groove's width S1 in the region R1 is set larger than the groove's width S2 in the region R2. In addition, the groove's width dimension S2 is set slightly larger than the plate thickness S3 of the first terminals 20.

Moreover, the region R1 includes a region that overlaps with the upper opening of the receiving groove 14 and the lower opening of the receiving groove 15, if the housing 10 is viewed from upper side. In other words, as shown in FIG. 4, the left part of the region R1 is provided right under the upper opening and right above the lower opening.

According to the embodiment, as described above, the region R1 has larger groove width than the region R2 and the gap from the plate surfaces of the first terminals 20 in the region R1 is formed large. The region R1 includes a region that overlaps with the upper opening and the lower opening. Therefore, when the pressing member 40 is at the open position shown in FIGS. 3(A) and 3(B), even if foreign matters such as dust fall and enter from the upper opening of the receiving groove 14, the dust may fall and then be discharged outside from the lower opening through the left part of the gap in the region R1.

Accordingly, according to the embodiment, since dust falls and then will be discharged from the housing 10, dust will not deposit in the receiving groove 14 and in the housing groove 15. Therefore, it is possible to satisfactorily prevent problems such as short circuit between adjacent terminals due to adhesion of the dust to the first terminals 20 and the second terminals 30.

In addition, if the first connecting section 24 of each first terminal 20 is connected by soldering to a signal circuit section on the circuit board, the solder and the flux may crawl up from the first connecting section 24 towards the first contact section 22A by a capillary phenomenon. According to the present invention, however, since the gap is formed in the region R1, such capillary phenomenon will not take place in such wide gap, and the solder and the flux will not crawl up further. As a result, it is possible to satisfactorily prevent occurrence of poor connection due to adhesion of the solder and the flux to the first contact sections 22A.

As shown in FIG. 1, the pressing member 40 is formed to have almost the same dimension as the sidewalls 11 and 12 of the housing 10 in the terminal arrangement direction, and as well shown in FIGS. 3(A) and 3(B), the pressing member 40 is provided above the sidewall 11. The pressing member 40 can pivotally move between the open position where the pressing member 40 extends in the vertical direction as shown in FIG. 1 and the close position where the pressing member 40 is generally orthogonal to the open position as shown in FIG. 2. As shown in FIGS. 3(A) and 3(B), the pressing member 40 includes slit-like grooves 41, as seen in the lower half part when it is in the open position, at the same positions as the first terminals 20 in the terminal arrangement direction.

As shown in FIGS. 3(A) and 3(B), in each groove 41, a rotary shaft 42, whose section taken orthogonally to the terminal arrangement direction is circular, and a rectangular rotary restriction section 43 are integrally formed like an island, and the facing inner wall surfaces of the groove 41 are joined by the rotary shaft 42 and the rotary restriction section 43. The rotary shaft 42 is freely rotatably supported by the rotary support section 23A of the first terminal 20, and works as a rotary shaft of the pressing member 40.

Figure 6B:
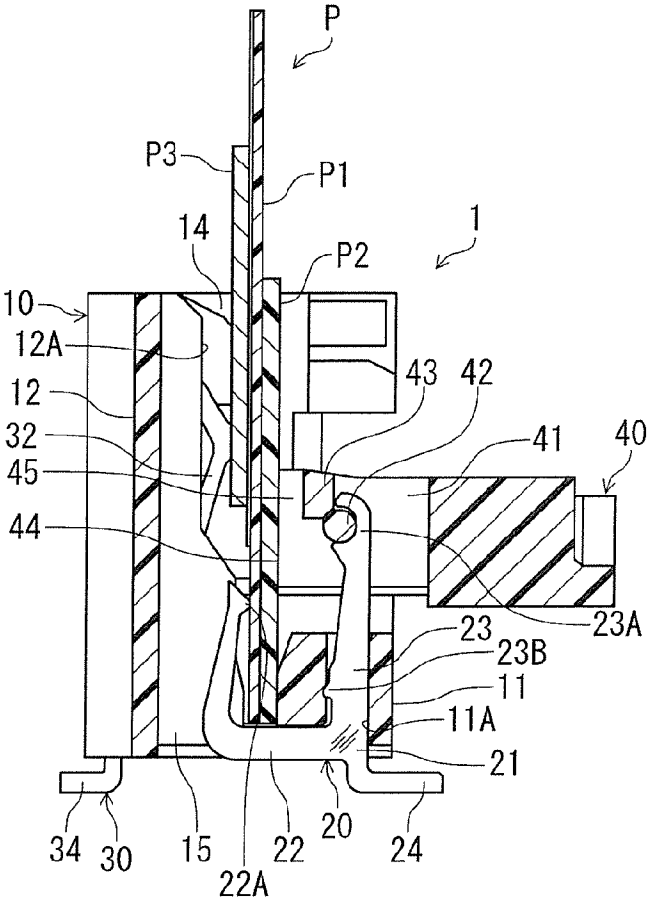
Figure 6A:
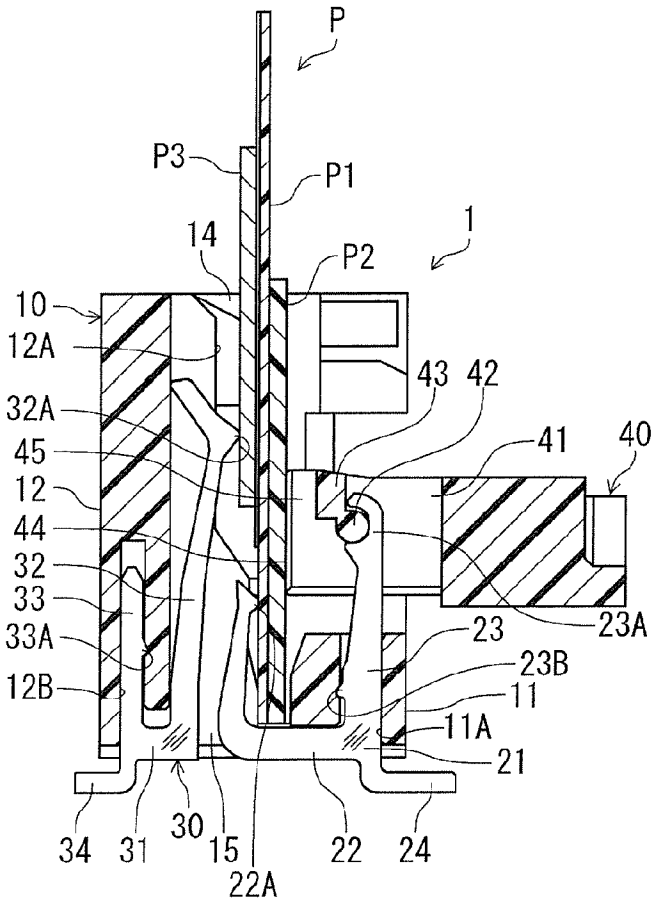

In addition, the rotary restriction section 43 contacts with a tip of the rotary support section 23A at the close position when the pressing member 40 moves from the open position to the close position (see FIGS. 6(A) and 6(B)). As a result, further rotary movement of the pressing member 40 is restricted and the pressing member 40 is kept at the close position.

As will be described later, the lower end part of the pressing member 40 at the open position shown in FIGS. 3(A) and 3(B) protrudes into the receiving groove 14 at the close position and is formed as the pressing section 44, which presses the flat conductive member P towards the first contact sections 22A of the first terminals 20 and the second contact sections 32A of the second terminals 30 (see FIGS. 6(A) and 6(B)).

As will be described later, the groove part provided lower than the rotary restriction section 43 of the pressing section 44 at the open position when the pressing member 40 is at the open position forms a communicating groove 45, which is in the receiving groove 14 and goes through in the vertical direction when the pressing member 40 moves to the close position. At the close position, the communicating groove 45 connects between the receiving groove 14 and the housing groove 15 in the vertical direction (see FIGS. 6(A) and 6(B)).

As well shown in FIG. 2, when the pressing member 40 is at the close position, there are formed lock-in sections 46, which are linear protrusions that extend in the facing direction of the sidewalls 11 and 12 at the both ends of the pressing member 40. As shown in FIG. 1, the lock-in sections 46 are designed to lock into the locking section 51 of the locking hardware 50, which will be described later.

The locking hardware 50 is made by punching sheet metal and then bending in the plate thickness direction. As shown in FIGS. 1 and 2, the locking hardware 50 includes an attaching section (not illustrated) that is to be attached and extends in the vertical direction, and a locking section 51, which is bent so as to protrude towards inside the connector in the terminal arrangement direction.

In the embodiment of the present invention, the locking hardware 50 is attached into the recess 16 by pressing the attaching section into the locking hardware attachment hole (not illustrated), which is formed at a bottom of the recess 16 of the housing 10, from thereabove. Then, when the pressing member 40 is at the open position shown in FIG. 1, the locking section 51 keeps the pressing member 40 at the open position by locking to the lock-in sections 46, which are formed at the both ends of the pressing member 40.

FIGS. 6(A) and 6(B) are longitudinal sectional views showing the circuit board electrical connector after the flat conductive member is inserted into the circuit board electrical connector according to the embodiment of the present invention. More specifically, FIG. 6(A) is a sectional view of the circuit board electrical connector corresponding to FIG. 3(A) and FIG. 6(B) is a sectional view of the circuit board electrical connector corresponding to FIG. 3(B). Hereunder, referring to FIGS. 3(A) and 3(B) and FIGS. 6(A) and 6(B), connection between the connector 1 and the flat conductive member P will be described.

First, with the pressing member 40 being at the open position shown in FIGS. 3(A) and 3(B), insert the flat conductive member P into the receiving groove 14 from thereabove. Once the flat conductive member P is inserted in the receiving groove 14, a surface of the flat conductive member P (a surface on the left side in FIG. 6(A)), on which a signal circuit section and the ground bar P3 are formed, faces the first contact sections 22A of the first terminals 20 and the second contact sections 32A of the second terminals 30.

Next, pivotally move the pressing member 40 at the open position to the close position shown in FIGS. 6(A) and 6(B). At the close position, the pressing section 44 of the pressing member 40 protrudes into the receiving groove 14, and presses the flat conductive member P to the first contact sections 22A of the first terminals 20 and the second terminals 32A of the second terminals 30A. As a result, the contact pressure between the first contact sections 22A and the signal circuit section and the contact pressure between the second contact sections 32A and the ground bar P3 are enhanced.

According to the embodiment, since the second elastic arm portion 32 of each second terminal 30 is held like a cantilever in its free state, if the pressing member 40 pivotally moves to the close position after insertion of the flat conductive member P and thereby the ground bar P3 presses the second contact section 32A, the whole second elastic arm portion 32 itself easily elastically displaces leftward.

Then, once the elastic displacement reaches specific amount, as shown in FIG. 6(A), the upper end of each second elastic arm portion 32 contacts with an inner wall surface of the sidewall 12 and becomes held at the both end, so that it hardly elastically displaces in comparison with when it is held like a cantilever. As a result, since excess elastic displacement of the second elastic arm portion 32 becomes restricted, it is possible to prevent damages (permanent setting in fatigue) of each second elastic arm portion 32 and to achieve high contact pressure between the second contact section 32A and the ground bar P3.

At the close position, as shown in FIGS. 6(A) and 6(B), the communicating groove 45 of the pressing member 40 is located in the receiving groove 14, and the receiving groove 15 and the housing groove 15 communicate to each other in the vertical direction via the communicating groove 45. Accordingly, even if foreign matters, such as dust, fall and enter from the upper opening of the receiving groove 14, such dust falls and then will be discharged outside from the lower opening through the communicating groove 45 and the gap in the housing groove 15.

As a result, the dust will not deposit in the receiving groove 14 or in the housing groove 15. Therefore, it is possible to satisfactorily prevent problems such as short circuit between adjacent terminals due to adhesion of the dust onto the first terminals 20 and the second terminals 30. In addition, it is also possible to satisfactorily prevent poor connection to the flat conductive member P due to adhesion of the dust to the first contact sections 22A of the first terminals 20 and the second contact sections 32A of the second terminals 30.

In the embodiment, the first terminals and the second terminals are made by punching sheet metal, whereas it is also possible to make at least the first terminals or the second terminals by bending strip-like sheet metal in the plate thickness direction.

The disclosure of Japanese Patent Application No. 2010-022084, filed on Feb. 3, 2010 is incorporated in the application by reference.

While the invention has been explained with reference to the specific embodiments of the invention, the explanation is illustrative and the invention is limited only by the appended claims.

What is claimed is:

1. An electrical connector to be mounted on a circuit board, comprising:

a housing including a bottom portion, a first sidewall, and a second sidewall, said first sidewall and said second sidewall being arranged to form a receptacle space for receiving a flat conductive member from above toward the bottom portion;

a first terminal attached to the first sidewall, said first terminal including a first base portion disposed at the bottom portion and a first elastic arm portion extending upwardly from the first base portion, said first elastic arm portion including a first contact section situated closer to the second sidewall relative to the flat conductive member; and a second terminal attached to the second sidewall, said second terminal including a second base portion disposed at the bottom portion and a second elastic arm portion extending from the second base portion upwardly and away from the bottom portion, said second elastic arm portion including a second contact section situated closer to the second sidewall relative to the flat conductive member, wherein said first contact section is situated at a lower position relative to the second contact section.

2. The electrical connector according to claim 1, wherein said first sidewall and said second sidewall are arranged to be perpendicular to the circuit board when the electrical connector is mounted on the circuit board.

3. The electrical connector according to claim 1, wherein said first terminal is situated closer to the bottom portion relative to the first sidewall, and said second terminal is situated closer to the bottom portion relative to the second sidewall.

4. The electrical connector according to claim 1, wherein said second elastic arm portion includes a lower portion extending away from the second sidewall and an upper portion extending closer to the second sidewall, said second contact section being formed at a bent portion between the lower portion and the upper portion.

5. The electrical connector according to claim 1, wherein said first terminal is arranged to a position the same as that of the second terminal in a width direction of the housing.

6. The electrical connector according to claim 1, further comprising a pressing member to be rotatable between an open position so that the flat conductive member is inserted into the receptacle space and a close position so that the pressing member presses the flat conductive member against the first contact section and the second contact section.

7. The electrical connector according to claim 6, wherein said pressing member includes a rotary shaft section and said first terminal includes a support arm portion for supporting the rotary shaft section so that the pressing member rotates around the rotary shaft section.

8. The electrical connector according to claim 1, wherein said second terminal is arranged to function as a ground terminal.

9. The electrical connector according to claim 1, further comprising a third terminal having a configuration similar to that of the first terminal, said third terminal being attached to the first side wall at a position adjacent to the first terminal and shifted from that of the second terminal in a longitudinal direction of the electrical connector.

10. The electrical connector according to claim 1, wherein said first terminal and said second terminal are arranged so that the first contact section and the second contact section contact with the flat conductive member on a same side thereof.

* * * * *